US007714687B2

(12) United States Patent
Marui et al.

(10) Patent No.: US 7,714,687 B2
(45) Date of Patent: May 11, 2010

(54) TRANSFORMER

(75) Inventors: Tomio Marui, Mie (JP); Koji Nakashima, Mie (JP); Toshiyuki Nakata, Mie (JP)

(73) Assignee: Panasonic Corporation, Osaka (JP)

( * ) Notice: Subject to any disclaimer, the term of this patent is extended or adjusted under 35 U.S.C. 154(b) by 859 days.

(21) Appl. No.: 10/592,170

(22) PCT Filed: Feb. 28, 2005

(86) PCT No.: PCT/JP2005/003299

§ 371 (c)(1),
(2), (4) Date: Sep. 8, 2006

(87) PCT Pub. No.: WO2005/086187

PCT Pub. Date: Sep. 15, 2005

(65) Prior Publication Data

US 2007/0171022 A1 Jul. 26, 2007

(30) Foreign Application Priority Data

Mar. 9, 2004 (JP) ..... 2004-065169

(51) Int. Cl.

| | |
|---|---|
| ***H01F 27/30*** | (2006.01) |
| ***H01F 27/02*** | (2006.01) |
| ***H01F 21/06*** | (2006.01) |
| ***H01F 27/28*** | (2006.01) |
| ***H01F 17/04*** | (2006.01) |

(52) U.S. Cl. ..... 336/198; 336/83; 336/131; 336/145; 336/182; 336/208; 336/220; 336/221

(58) Field of Classification Search ..... None
See application file for complete search history.

(56) References Cited

U.S. PATENT DOCUMENTS 3,480,229 A * 11/1969 Entremont ..... 242/118.4
4,250,479 A * 2/1981 Bausch et al. ..... 336/208

(Continued)

FOREIGN PATENT DOCUMENTS

JP 9-237721 A 9/1997

(Continued)

OTHER PUBLICATIONS

International Search Report for PCT/JP2005/003299, dated May 31, 2005.

*Primary Examiner*—Lincoln Donovan
*Assistant Examiner*—Mangtin Lian
(74) *Attorney, Agent, or Firm*—RatnerPrestia

(57) ABSTRACT

In a transformer including a coil part having a first bobbin to which a coil is mounted, a second bobbin to be fitted to the first bobbin combined to each other, the coil part being sandwiched between magnetic cores from above and below, the first bobbin includes at least one lead drawing through holes on a periphery on the inner peripheral side of a coil mounting surface, and at least one of coil-drawn-leads of the coil is drawn through the lead drawing through hole. With this transformer, coming out of the coil-drawn-lead, displacement, and erroneous wiring are prevented, and hence the inserting capability of the coil is improved. Therefore, the workability is remarkably improved, and hence a product which is low in price can be provided.

4 Claims, 14 Drawing Sheets

U.S. PATENT DOCUMENTS

| | | | | |
|---|---|---|---|---|
| 6,774,755 | B2 * | 8/2004 | Nakata et al. | 336/83 |
| 2001/0016977 | A1 * | 8/2001 | Moro et al. | 29/606 |

FOREIGN PATENT DOCUMENTS

| | | | | |
|---|---|---|---|---|
| JP | 10-125545 | A | | 5/1998 |
| JP | 10-261529 | | * | 9/1998 |
| JP | 10-261529 | A | | 9/1998 |
| JP | 2001-52917 | A | | 2/2001 |

* cited by examiner

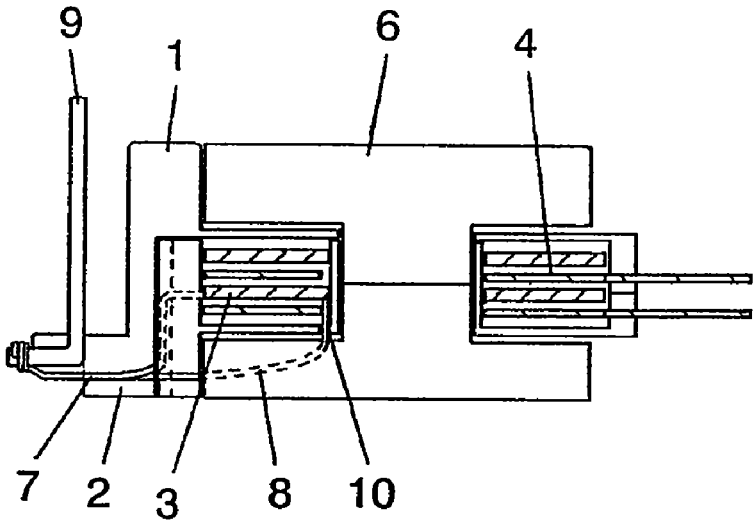
FIG. 24 PRIOR ART
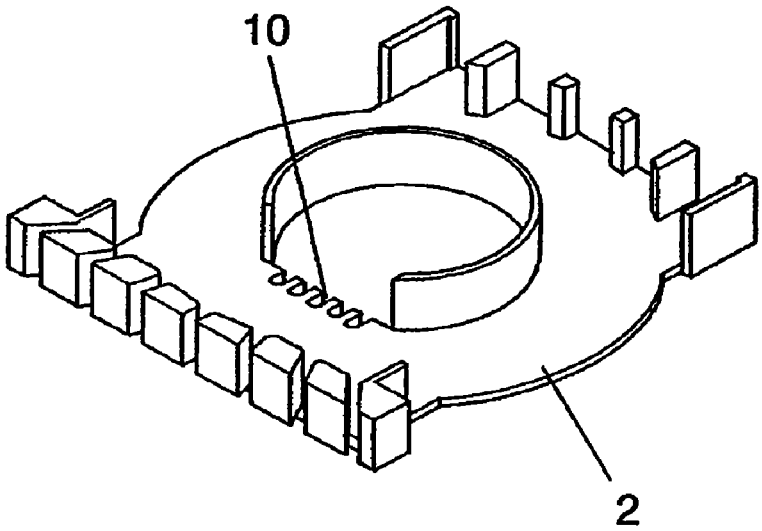

TRANSFORMER

This application is a U.S. National Phase Application of PCT International Application PCT/JP2005/003299.

TECHNICAL FIELD

The present invention relates to a transformer to be mounted to a switching power source.

BACKGROUND ART

In recent years, power consumption is increasing in all the electronic devices in association with significant increase in amount of info-communication. In contrast, a switching power source is required to be compact and low in price.

The transformer of this type has a configuration shown in FIGS. 22, 23, 24, 25 and 26.

In other words, as shown in FIG. 22, primary coil 3 and secondary coil 4 are laminated alternately via insulating film 5 on bobbin 2. Then, bobbin 1 is fitted and magnetic core 6 is inserted. FIG. 23 is a cross-sectional view thereof. Lead drawing holes 10 are formed on bobbin 2, and an input and an output to/from primary coil 3 or secondary coil 4 are drawn through lead drawing holes 10 and are connected to pin terminals 9.

FIG. 24 is a perspective view of bobbin 2, and shows positions and shapes of lead drawing holes 10. FIG. 25 shows a state of mounting a coil to a bobbin. As shown in FIG. 25, primary coil 3 assumes a state of a coil, and distal end 13 of drawn lead 12 of primary coil 3 is inserted to a recess of lead drawing hole 10 from above bobbin 2. Then, primary coil 3 is moved downward and inserted into center leg portion 14. Primary coil 3 is inserted to a position shown in FIG. 26.

Such a related art is disclosed, for example, in Japanese Patent Unexamined Publication No. 10-261529. In Japanese Patent Unexamined Publication No. 10-261529, a lead drawing structure in the related art is described.

In the transformer in the related art as described above, when a coil is mounted to a bobbin, a distal end of a drawn lead is entered into a recess of a lead drawing hole of the bobbin and, while maintaining this state, an inner hole of the coil is inserted into a center leg portion of the bobbin. In this state, insertion of the coil is performed while holding the drawn lead so that the drawn lead does not come out from the recess. When the drawn lead is not maintained in a specified recess, there may arise problems such that the bobbin cannot be fitted, it may come into contact with a magnetic core, or it is wired to a wrong pin terminal. When such an event is occurred, a fatal defect is resulted as a transformer. Therefore, the coil inserting operation is performed gradually and deliberately.

Normally, there are a plurality of the coils. Therefore, it is necessary to insert a subsequent coil attentively so as not to apply a stress to cause the drawn lead of the coil which is mounted previously to come out from the recess when inserting the subsequent coil. Therefore, the workability is very low.

When laminating the plurality of the coils, positions of the drawn leads may be displaced according to variation in arrangement of the coils or finished dimension of the coils. Consequently, other lead drawing holes may be occupied by previously inserted coils, whereby there may arise a case in which the drawn lead of the subsequent coil cannot be inserted.

Therefore, the drawn lead must be inserted into the recess while adjusting the position of the drawn lead, and a number of processes of operation are required for correction thereof.

DISCLOSURE OF INVENTION

In a drawn transformer including a coil part having a first bobbin to which a coil is mounted, a second bobbin to be fitted to the first bobbin combined to each other, the coil part being sandwiched between magnetic cores from above and below, the first bobbin includes at least one lead drawing through holes on a periphery on the inner peripheral side of a coil mounting surface, and at least one of coil-drawn-leads of the coil is drawn through the lead drawing through hole.

BRIEF DESCRIPTION OF THE DRAWINGS

FIG. 23 is a cross-sectional view showing a structure of the transformer in the related art.

FIG. 24 is an appearance perspective view showing an appearance of a bobbin of the transformer in the related art.

REFERENCE NUMERALS

Figure 1:
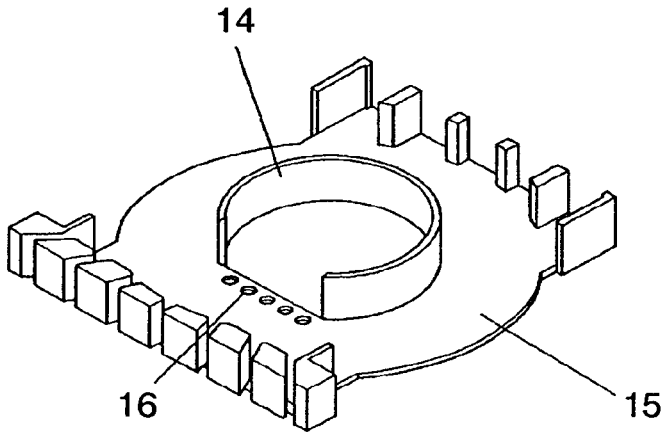
FIG. 1 is an appearance perspective view of a transformer formed with a through hole on a bobbin according to an embodiment of the invention.

3 first coil
3*a* second coil
12 coil-drawn-lead
13 distal end of coil-drawn-lead
14 center leg portion of bobbin
15 bobbin
16 lead drawing through hole
17 drawn lead introduction wall
18 distal end of drawn lead
19 lead drawing through hole
20 drawn lead introduction wall
21 magnetic core
22 magnetic core
23 magnetic core
24 magnetic core
25 lead avoiding notch
26 lead avoiding notch
27 lead avoiding step

DETAILED DESCRIPTION OF THE PREFERRED EMBODIMENTS

The invention is intended to solve the above-described problems, whereby positioning of a coil drawing lead is reliably achieved when inserting a coil into a bobbin to improve a coil inserting capability. In lamination of a plurality of the coils, variation in coil dimension can be absorbed, so that the coil can be inserted into the bobbin with ease. Therefore, a workability is improved and hence a transformer which is low in price can be manufactured.

According to the transformer in the invention, displacement and coming-out of a drawn lead are prevented, and an introduction wall for introducing the coil-drawn-lead to a through hole thereof, whereby the inserting capability when inserting the coil-drawn-lead into the through hole is improved, which facilitates coil insertion. Since an insertion space of the drawn lead hole can reliably be secured, a state such that the drawn lead hole is occupied by the previously inserted coil, so that the coil to be inserted after cannot be inserted is eliminated. By forming the drawn lead through hole into an oval, displacement of the position of the drawn lead caused by variation in coil shape can be absorbed, and a plurality of the coil-drawn-leads can be inserted. Consequently, the productivity is improved, and the transformer which is low in price can be provided.

First Embodiment

Referring now to FIG. 1 to FIG. 10, a first embodiment of the invention will be described below.

Figure 2:
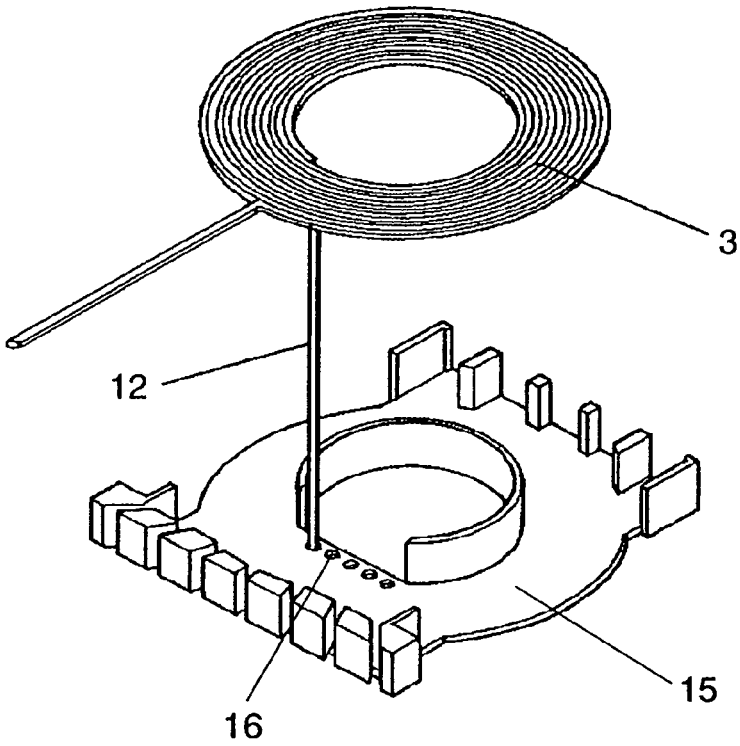
FIG. 2 is a perspective view of the transformer before the bobbin and a coil are inserted according to the embodiment of the invention.
Figure 3:
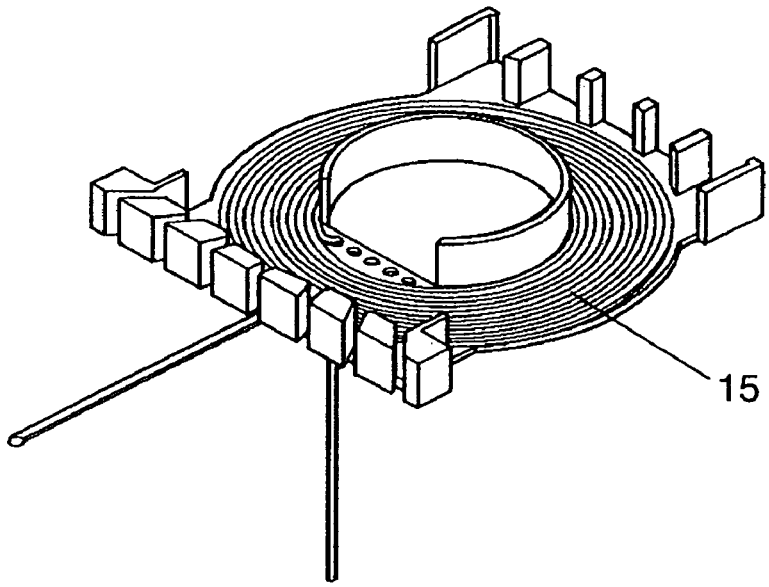
FIG. 3 is a perspective view of the transformer after the bobbin and the coil are inserted according to the embodiment of the invention.

FIG. 1 is a perspective view of a first bobbin according to the first embodiment of the invention. FIG. 2 shows a state in which a coil-drawn-lead is inserted into a through hole for a drawn lead in the invention when inserting the coil to the first bobbin according to the first embodiment. FIG. 3 is a drawing showing a state in which insertion of the coil to the first bobbin is completed.

The transformer in the invention is a transformer in which a coil part including the first bobbin to which the coil is mounted and a second bobbin to be fitted to the first bobbin combined to each other is sandwiched between magnetic cores from above and below. However, in the description and the drawings of the respective embodiments shown below, the second bobbin is omitted. In the description and the drawings shown below, second bobbin 15 is referred to as bobbin 15. First coil 3 and second coil 3*a* are generically referred to as coil.

Bobbin 15 is provided with lead drawing through holes 16. When inserting first coil 3 into bobbin 15, firstly, coil-drawn-lead 12 passes through lead drawing through hole 16 and inserted to a position shown in FIG. 3. In this case, since lead drawing through hole 16 is a through hole, coil-drawn-lead 12 does not come out or fall out from lead drawing through hole 16 even when inserting the coil into center leg portion 14 of the bobbin once the drawn lead is inserted into the through hole. Therefore, coil insertion can be achieved easily. Even when the plurality of the coils are inserted, the inserting capability does not change, and hence insertion can be performed easily.

Figure 4:
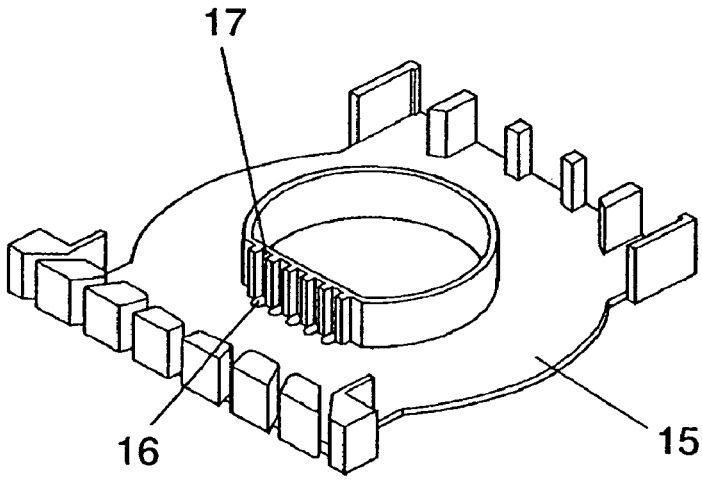
FIG. 4 is an appearance perspective view of the transformer provided with a drawn lead introducing wall at the through hole of the bobbin according to the embodiment of the invention.
Figure 5:
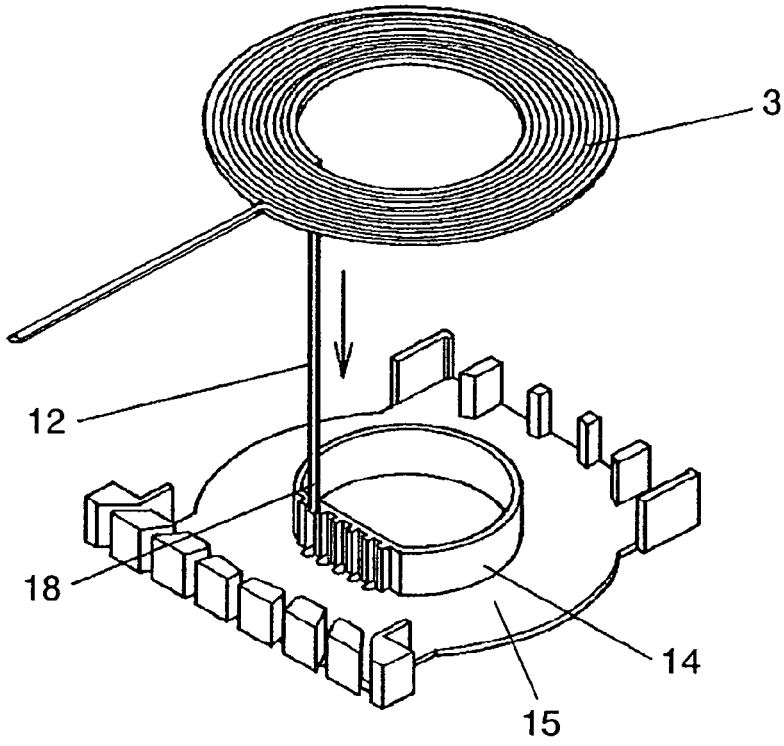
FIG. 5 is a perspective view of the transformer before the bobbin and the coil are inserted according to the embodiment of the invention.
Figure 6:
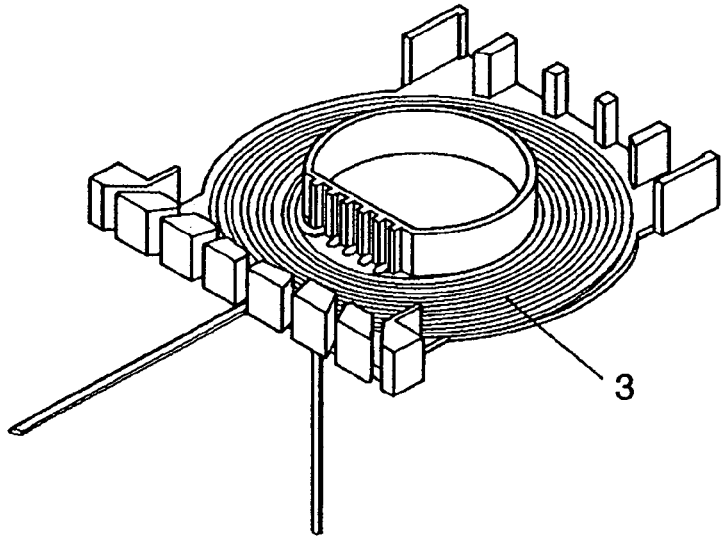
FIG. 6 is a perspective view of the transformer after the bobbin and the coil are inserted according to the embodiment of the invention.

FIG. 4 and FIG. 5 show a state in which the coil-drawn-lead is inserted along the drawn lead introduction wall in the invention when inserting the coil in the bobbin in the transformer according to the invention. FIG. 6 shows a state in which insertion of the coil into the bobbin is completed.

Bobbin 15 is formed with lead drawing through holes 16. Drawn lead introduction walls 17 projecting toward a coil laminating surface are provided so as to extend partly along peripheries of lead drawing through holes 16.

Figure 7:
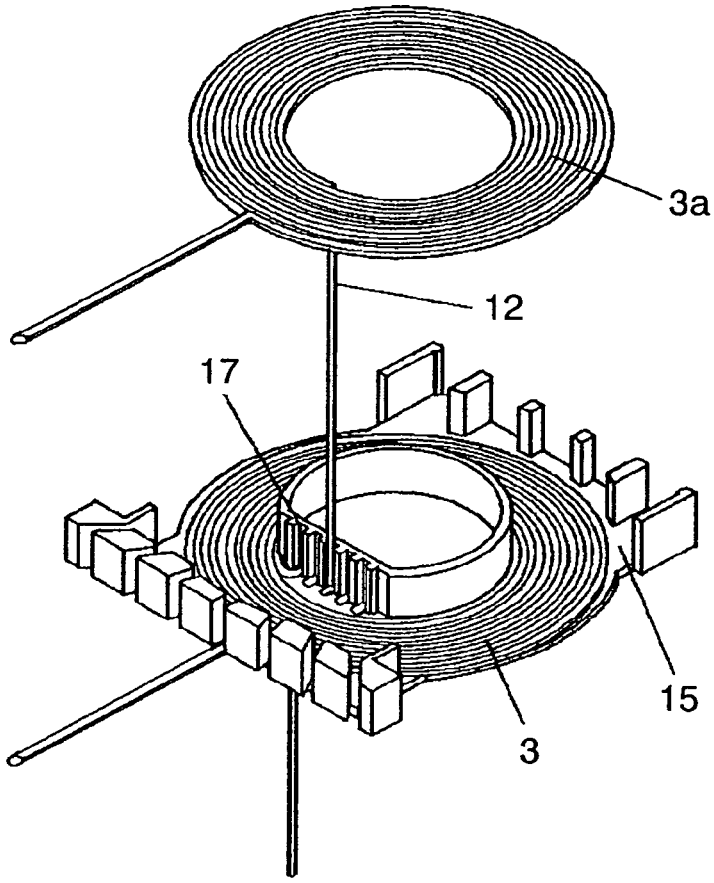
FIG. 7 is a perspective view of the transformer with the bobbin and a plurality of the coils being inserted according to the embodiment of the invention.

When inserting first coil 3 into bobbin 15, distal end 18 of drawn lead of coil-drawn-lead 12 is passed through lead drawing through hole 16 along drawn lead introduction wall 17. Then, first coil 3 is inserted to a position shown in FIG. 6. Coil-drawn-lead 12 does not move to another hole once it is entered into drawn lead introduction wall 17. FIG. 7 shows a case in which the plurality of the coils are inserted, in which second coil 3*a* is inserted on first coil 3. In this case as well, coil-drawn-lead 12 of first coil 3 is fixed in position by lead drawing through hole 16 and drawn lead introduction walls 17. Therefore, the inserting capability of second coil 3*a* is as easy as first coil 3. It is also not necessary to work while paying attention to displacement of first coil 3 and lifting of the drawn lead.

In this configuration, insertion of the coil into the bobbin can be performed easily and possibility of erroneous wiring is eliminated, whereby the number of processes of operation is reduced and hence a transformer which is low in price is provided.

Figure 8:
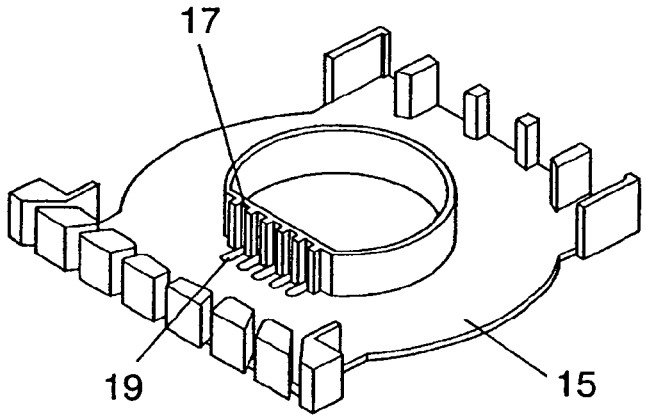
FIG. 8 is an appearance perspective view of an oval hole of the bobbin of the transformer according to the embodiment of the invention.

FIG. 8 shows a state in which the shape of lead drawing through holes 19 is oval. Since they are oval, even when the coil shape and the position of the drawn lead dimension are varied, such variations can be absorbed by the oval. In addition, since the plurality of the coil-drawn-leads can be inserted into the same lead drawing through hole 19, flexibility in design of the coil is increased.

Figure 9:
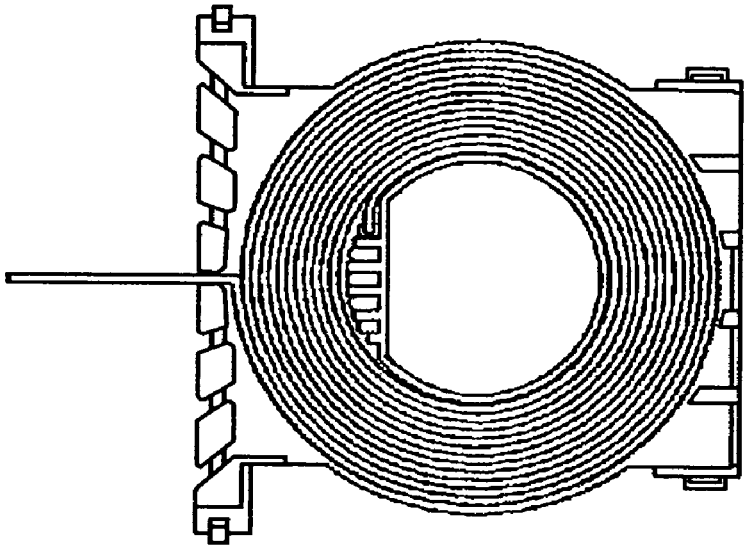
FIG. 9 is a top view of the transformer after the bobbin and the coil are inserted according to the embodiment of the invention.
Figure 10:
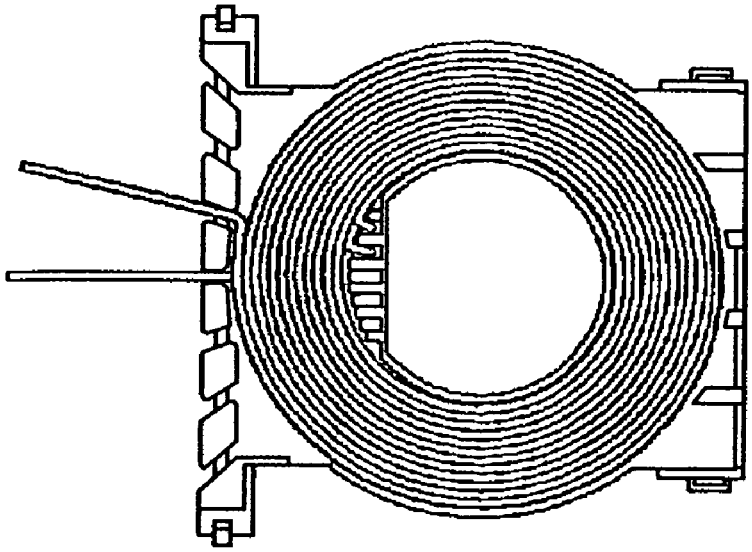
FIG. 10 is a top view of the transformer after the bobbin and the coil are inserted according to another embodiment of the invention.

FIG. 9 is a top view of the transformer shown in FIG. 6. FIG. 10 is a top view of the transformer shown in FIG. 7 after both of first coil 3 and second coil 3*a* are mounted.

Second Embodiment

Referring now to FIG. 11 to FIG. 15, a second embodiment of the invention will be described below.

Figure 11:
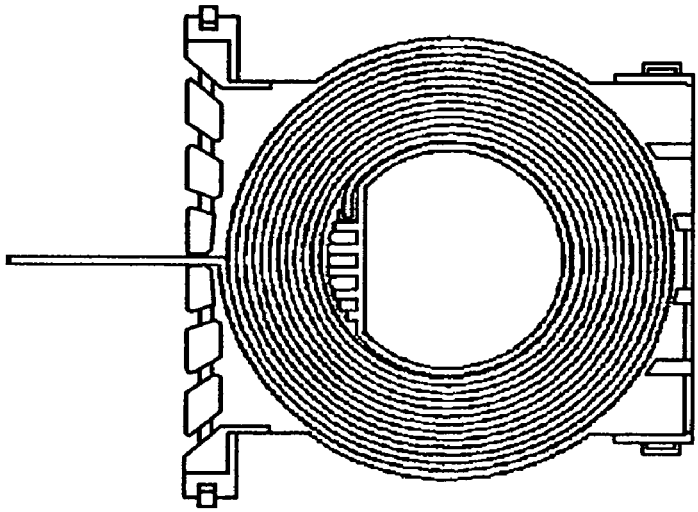
FIG. 11 is a top view of the transformer after the bobbin and the coil are inserted according to another embodiment of the invention.
Figure 12:
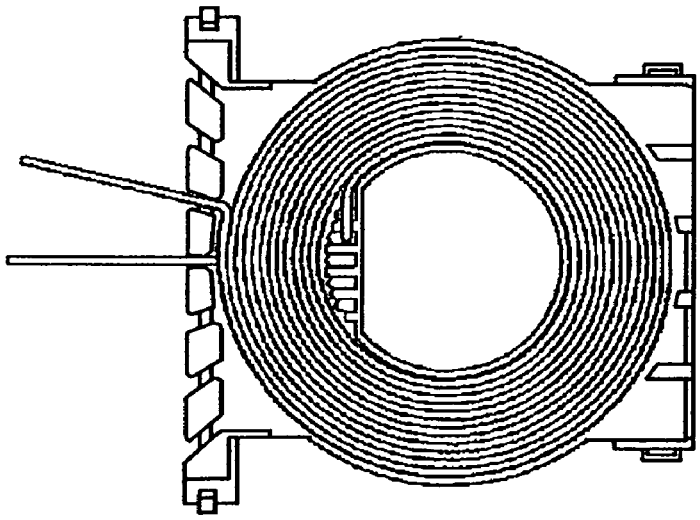
FIG. 12 is a top view of the transformer after the bobbin and the coil are inserted according to another embodiment of the invention.
Figure 13:
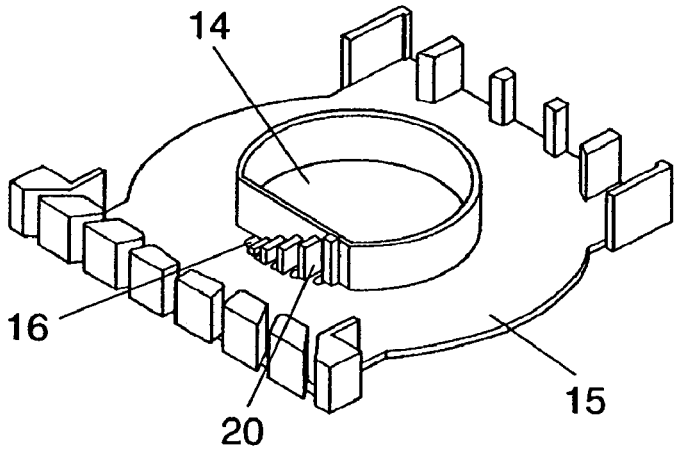
FIG. 13 is a perspective view of the bobbin of the transformer according to another embodiment of the invention.
Figure 14:
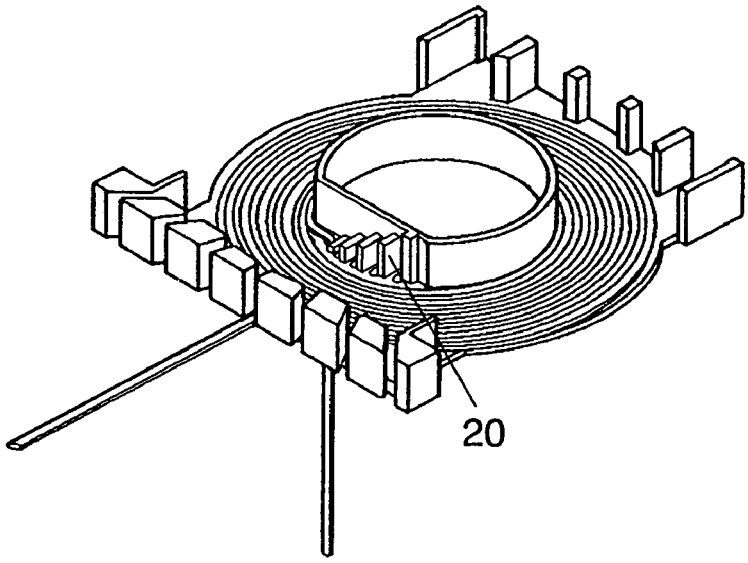
FIG. 14 is a perspective view of the transformer after the bobbin and the coil are inserted according to another embodiment of the invention.
Figure 15:
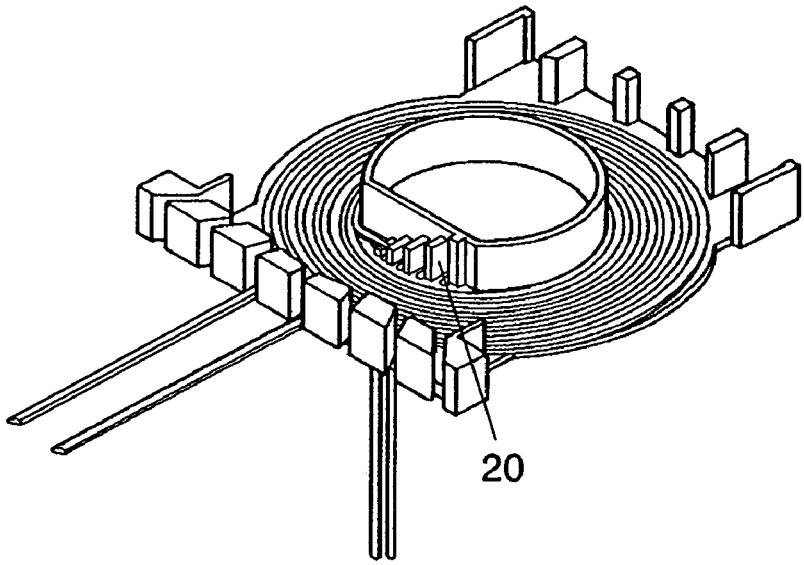
FIG. 15 is a perspective view of the transformer after the bobbin and the coil are inserted according to another embodiment of the invention.

FIG. 11 and FIG. 12 are top views of the transformer according to the second embodiment of the invention after the bobbin and the coil are inserted. FIG. 13 is a perspective view of the bobbin of the transformer according to the second embodiment of the invention. FIG. 14 and FIG. 15 are perspective views of the transformer according to the second embodiment of the invention after the bobbin and the coil are inserted.

In FIG. 13, lead drawing through holes 16 are formed in the vicinity of center leg portion 14 of bobbin 15. FIG. 11 is a top view showing a state after first coil 3 is mounted, FIG. 12 is a top view showing a state after first coil 3 is mounted and then second coil 3*a* is mounted. FIG. 14 is a perspective view showing a state after first coil 3 is mounted, and FIG. 15 is a perspective view showing a state after first coil 3 is mounted and then second coil 3*a* is mounted. Drawn lead introduction walls 20 are provided in the vicinity of lead drawing through holes 16. A plurality of drawn lead introduction walls 20 are provided and the height is not the same. The heights of drawn lead introduction walls 20 are set to be lower than the height corresponding to the length of the coil lead to be inserted. Therefore, coil-drawn-lead 12 can be inserted into lead drawing hole 16 along the concentric circle of the wound coil, whereby the inserting capability is improved. Since the extremity of coil-drawn-lead 12 does not have to be bent at a right angle, a mechanical stress to the lead wire is eliminated, and hence the reliability is improved.

Third Embodiment

Subsequently, referring to FIG. 16 to FIG. 19, FIG. 20A, FIG. 20B, FIG. 21A and FIG. 21B, a third embodiment of the invention will be described below.

In the third embodiment, the effects in the first embodiment and the second embodiment described above are further enhanced. In other words, deformation or damage of the coil-drawn-lead can be avoided even when sandwiching the bobbin in which the coil is inserted by the upper and lower magnetic cores from above and below to finish the transformer. In addition, the possibility of contact between the coil-drawn-lead and the magnetic cores can be avoided, and an insulation distance required by Safety Standard can be secured.

Figure 16:
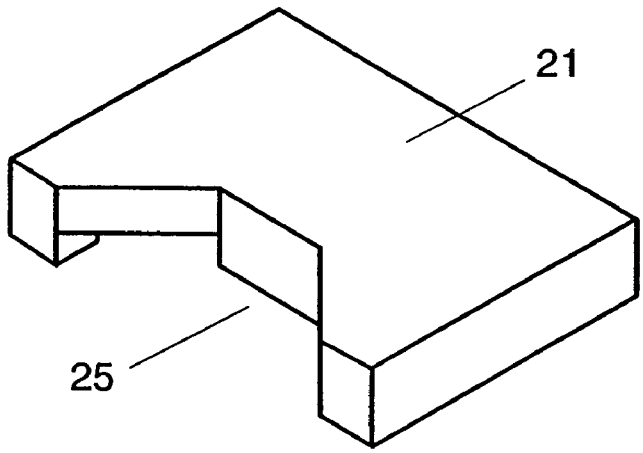
FIG. 16 is a perspective view of a core according to still another embodiment of the invention.
Figure 17:
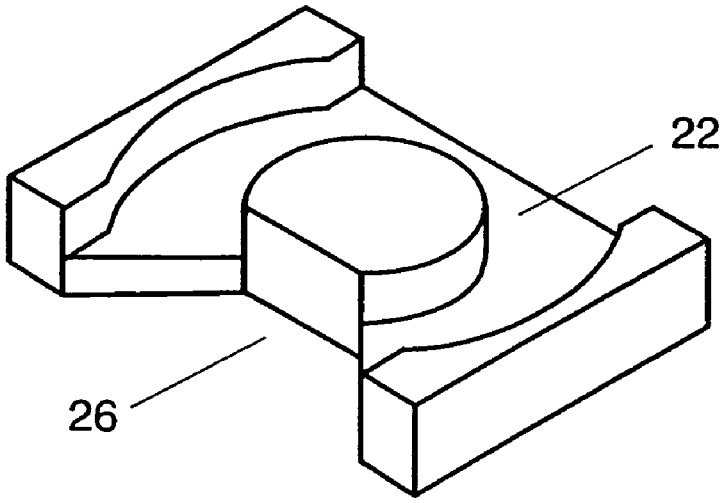
FIG. 17 is a perspective view of the core according to still another embodiment of the invention.
Figure 18:
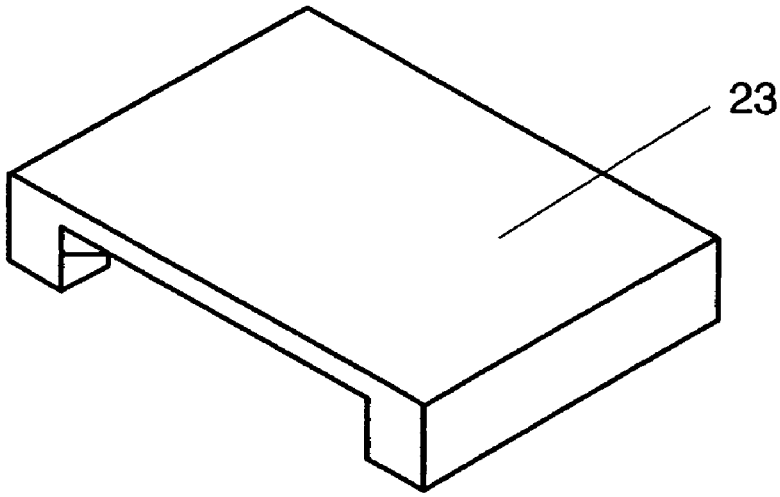
FIG. 18 is a perspective view of the core according to still another embodiment of the invention.
Figure 19:
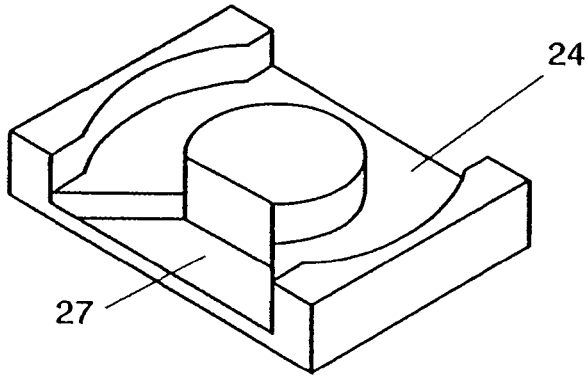
FIG. 19 is a perspective view of the core according to still another embodiment of the invention.
Figure 20A:
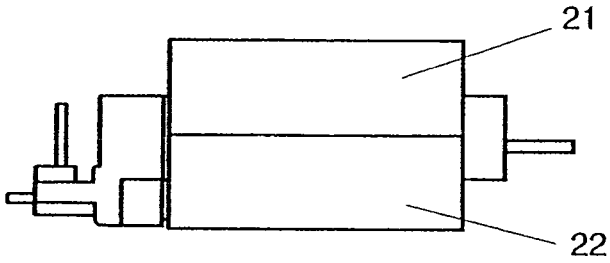
FIG. 20A is a side view of the transformer after assembly according to still another embodiment of the invention.
Figure 20B:
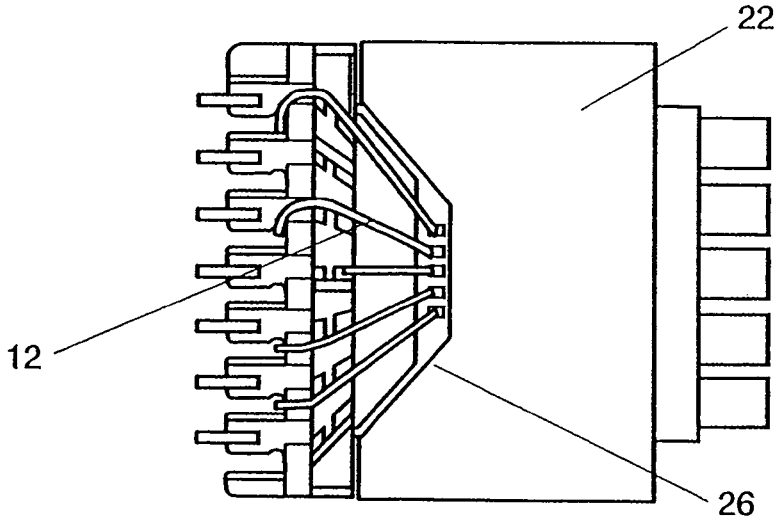
FIG. 20B is a top view of the transformer after assembly according to still another embodiment of the invention.
Figure 21A:
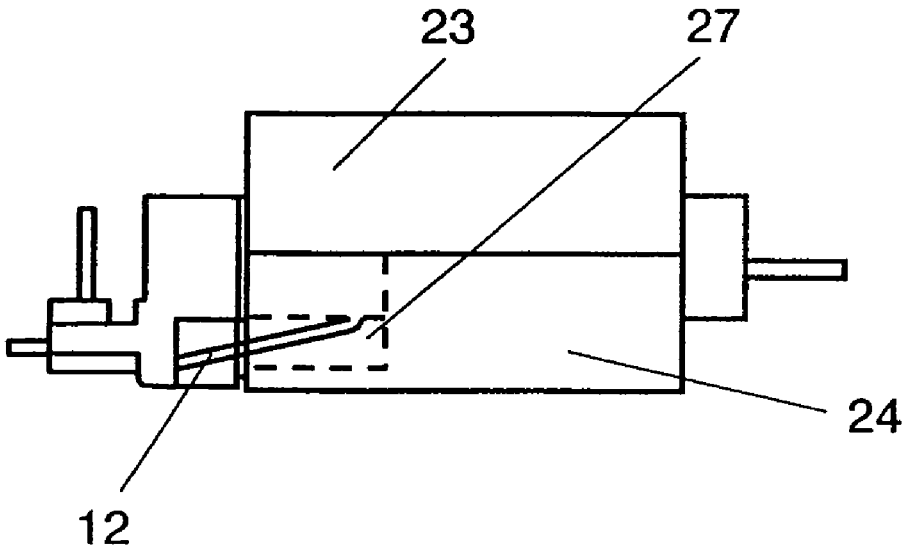
FIG. 21A is a side view of the transformer after assembly according to still another embodiment of the invention.
Figure 21B:
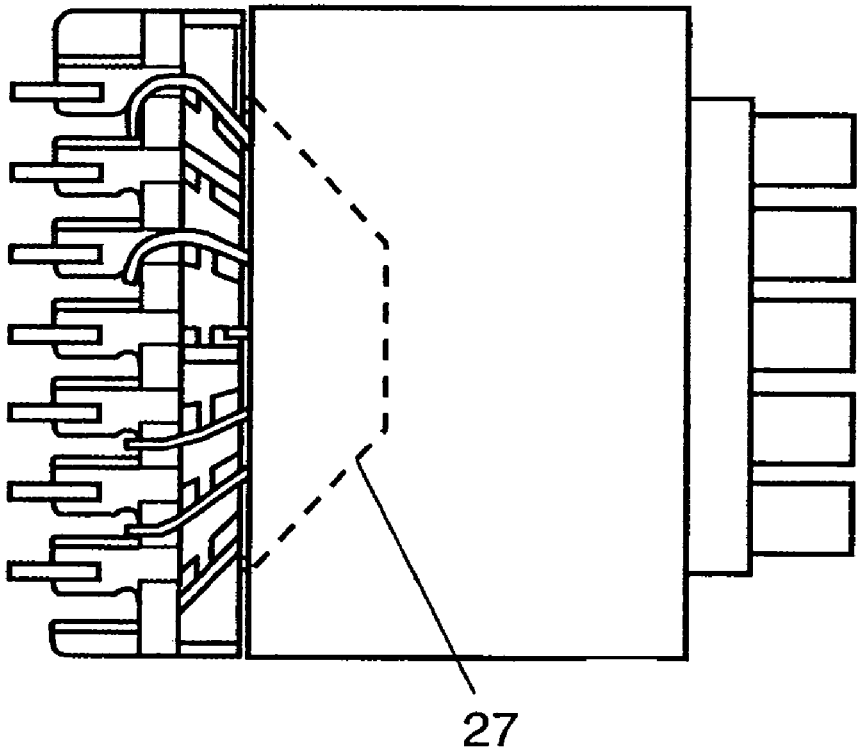
FIG. 21B is a front view of the transformer after assembly according to still another embodiment of the invention.
Figure 22:
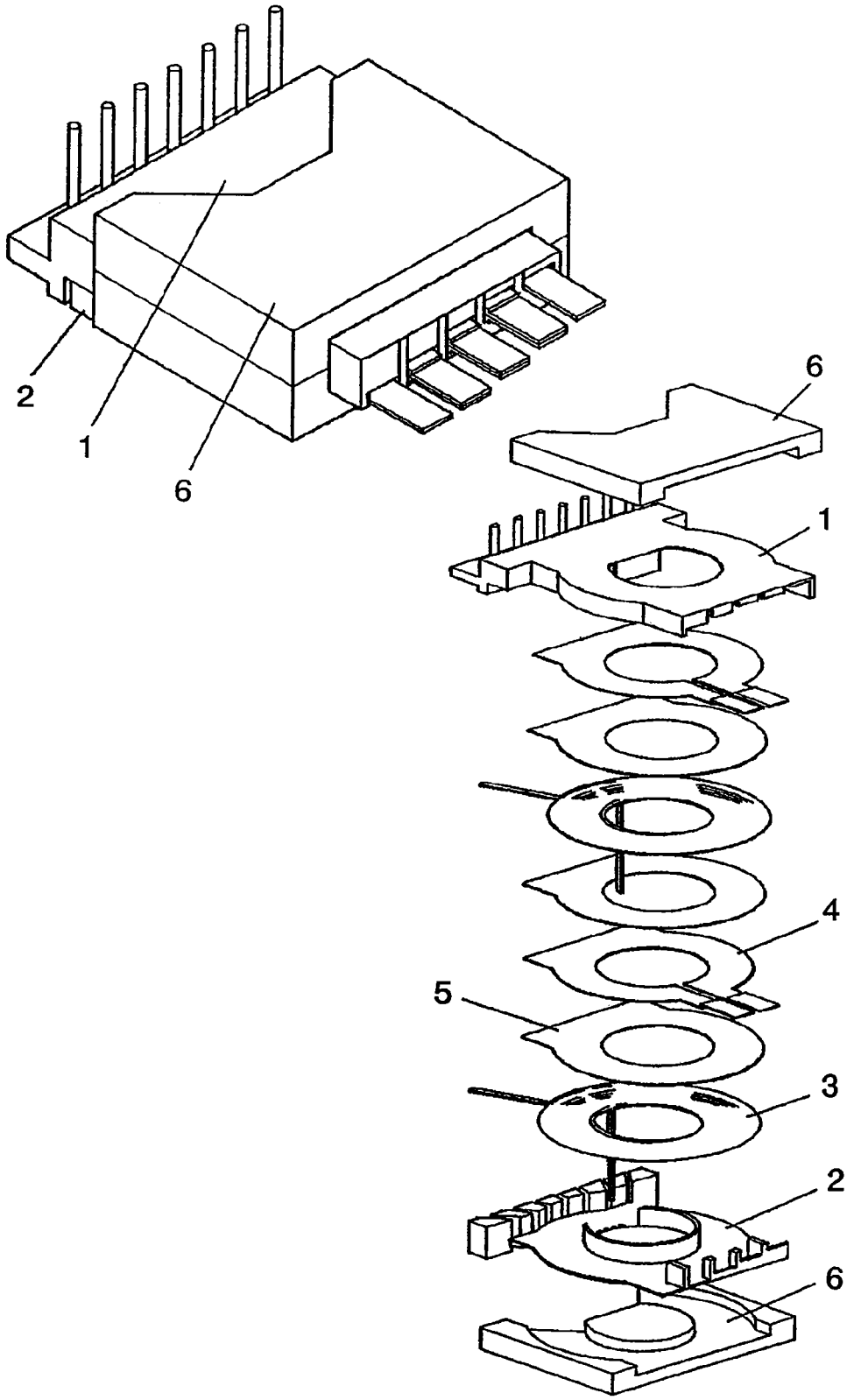
FIG. 22 PRIOR ART
FIG. 22 is a cross-sectional view of a transformer in the related art showing a structure and a method of assembly thereof.
Figure 25:
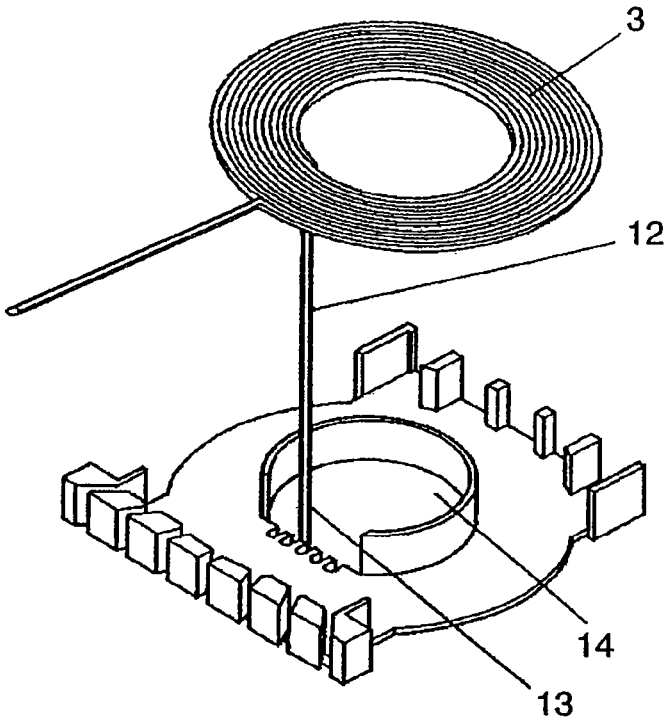
FIG. 25 PRIOR ART
FIG. 25 is a perspective view of the transformer before insertion of the bobbin and a coil in the related art.
Figure 26:
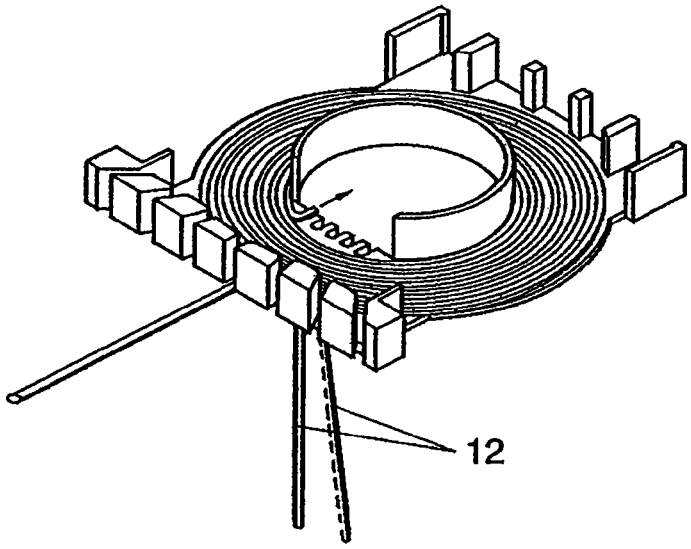
FIG. 26 PRIOR ART
FIG. 26 is a perspective view of the transformer in the related art after insertion of the bobbin and the coil.

FIG. 16 and FIG. 18 show the upper magnetic core in this embodiment, and FIG. 17 and FIG. 19 show the lower magnetic core in this embodiment. FIG. 20A is a side view of the transformer in this embodiment in which the magnetic core in FIG. 16 and the magnetic core in FIG. 17 are used, and FIG. 20B is a top view of the transformer in this embodiment in which the magnetic core in FIG. 16 and the magnetic core in FIG. 17 are used. FIG. 21A is a side view of the transformer in this embodiment in which the magnetic core in FIG. 18 and the magnetic core in FIG. 19 are used, and FIG. 21B is a top view of the transformer in this embodiment in which the magnetic core in FIG. 18 and the magnetic core in FIG. 19 are used.

Referring first to FIG. 15, FIG. 16, FIG. 17, FIG. 20A and FIG. 20B, this embodiment will be described. The bobbin in which the coil is inserted as shown in FIG. 15 is provided. The bobbin in which this coil is inserted is sandwiched by upper magnetic core 21 shown in FIG. 16 and lower magnetic core 22 shown in FIG. 17 respectively from above and below. Upper magnetic core 21 is provided with lead avoiding notch 25. Lower magnetic core 22 is provided with lead avoiding notch 26.

FIG. 20A and FIG. 20B show the transformer finished by sandwiching the bobbin in which the coil is inserted by upper magnetic core 21 shown in FIG. 16 and lower magnetic core 22 in FIG. 17 respectively from above and below.

The coil lead is drawn from a bottom surface of the transformer through lead drawing through hole 16. Needless to say, coil-drawn-lead 12 and magnetic core 22 are kept not to be in contact to each other, and the insulation distance required by Safety Standard must be secured. In the related art, when the entire surface of the magnetic core covers the bottom surface of the coil, the coil lead must be drawn from a position apart from the magnetic core. Therefore, the transformer is upsized. However, according to this embodiment, since lead avoiding notch 25 or lead avoiding notch 26 is provided on magnetic core 21 or magnetic core 22, the lead can be drawn from inside the magnetic core. In this arrangement, downsizing of the transformer is realized.

Magnetic core 21 in FIG. 16 is provided with lead avoiding notch 25, and magnetic core 22 in FIG. 17 is provided with lead avoiding notch 26. However, in the invention, the effects of this application can be demonstrated as long as the lead avoiding notch is provided on at least one of magnetic core 21 and magnetic core 22, as a matter of course.

Referring now to FIG. 15, FIG. 18, FIG. 19, FIG. 21A and FIG. 21B, this embodiment will further be described.

The bobbin in which the coil is inserted as shown in FIG. 15 is provided. The bobbin in which the coil is inserted is sandwiched by upper magnetic core 23 shown in FIG. 18 and lower magnetic core 24 shown in FIG. 19 respectively from above and below. Lower magnetic core 24 is provided with lead avoiding step 27.

FIG. 21A and FIG. 21B show the transformer finished by sandwiching the bobbin in which the coil is inserted by upper magnetic core 23 shown in FIG. 18 and lower magnetic core 24 shown in FIG. 19 respectively from above and below.

In the case of magnetic core 21 shown in FIG. 16 and magnetic core 22 shown in FIG. 17, a surface area of the magnetic core is slightly reduced by the provision of lead avoiding notch 25 or lead avoiding notch 26. In other words, a surface area that covers the coil is slightly reduced. Therefore, there arise side effects such that loss of the transformer is increased and increase in temperature is accelerated.

Magnetic core 24 in FIG. 19 is provided with lead avoiding step 27 at a part of magnetic core 24 in order to secure the distance with respect to the drawn lead without reducing the surface area of the magnetic core. On the other hand, there is no lead avoiding notch provided on magnetic core 23 shown in FIG. 18.

FIG. 21A and FIG. 21B show the transformer finished by sandwiching the bobbin in which the coil is inserted by upper magnetic core 23 shown in FIG. 18 and lower magnetic core 24 in FIG. 19 respectively from above and below. The coil-drawn-lead 12 is drawn from a gap secured by lead avoiding step 27. In this arrangement, deformation or damage of coil-drawn-lead 12 can be avoided even when sandwiching the bobbin in which the coil is inserted by upper and lower magnetic cores from above and below to finish the transformer. In addition, the possibility of contact between coil-drawn-lead 12 and magnetic core 24 can be avoided, and the insulation distance required by Safety Standard can be secured. Furthermore, increase in loss or increase in temperature rise of the transformer can be avoided, and hence a compact and high-efficiency transformer is obtained.

As is clear from the descriptions in conjunction with the respective embodiments, according to the configuration of the invention, when inserting the coil into the bobbin, the distal end of the coil-drawn-lead is inserted into the through hole first, and then a body portion of the coil is inserted into the bobbin. In this case, since the coil-drawn-lead is positioned by the through hole, coming out of the drawn lead from the hole, which has been occurred in the case of the hole in the related art, is eliminated, and hence insertion into the bobbin is facilitated.

Even when the coils are laminated into a plurality of layers, the inserted coil does not fall out from the lead drawing through hole, and even when an external force is applied to some extent during inserting operation of other coils, the position of the coil-drawn-lead does not change, and hence the inserting capability does not change, and insertion can be performed easily.

According to the configuration of the invention, when the coil-drawn-lead is inserted into the lead drawing through hole, the coil-drawn-lead is introduced to the lead drawing through hole by the drawn lead introduction wall. Therefore, since the coil-drawn-lead can be inserted into the lead drawing through holes only by aligning the distal end of the coil-drawn-lead with the distal end of the drawn lead introduction wall, and then pushing the coil along the drawn lead introduction wall, the inserting capability is remarkably improved.

Even when the coils are laminated into the plurality of layers, and hence there exist the plurality of the coil-drawn-leads, since there are the drawn lead introduction walls around the respective lead drawing through holes, insertion of the coil-drawn-lead into a wrong lead drawing through hole can be prevented. Therefore, an erroneous wiring can be prevented.

Since a space for allowing the coil-drawn-lead to enter is secured by the drawn lead introduction wall, the state in which a subsequent coil cannot be inserted because the lead drawing through hole is occupied by the previously inserted coil due to dimensional variation in position of the coil or coil-drawn-lead or the change in the order of lamination can be avoided irrespective of the number of lamination of the plurality of the coils.

From the reasons shown above, the coil insertion work is facilitated, the number of processes of operation can be reduced, and a transformer which is low in price can be provided.

According to the configuration of the invention, when the coil-drawn-leads are varied in position, such a variation can be absorbed, and hence the correction work for the drawing position for the drawn lead can be eliminated. Since the plurality of the coil-drawn-leads are inserted into the same lead drawing through hole, flexibility in design of the coil is achieved.

In the invention, differentiation of the height of the drawn lead introduction walls provided at the lead drawing through holes of the coil is also proposed. Therefore, the coil-drawn-lead can be inserted into the lead drawing through hole along the concentric circle of the wound coil, and hence the insertion capability is improved. Since bending of the lead extremely to a right angle is also avoided, the mechanical stress applied to the lead wire is eliminated, and hence the reliability is improved.

In the invention, downsizing of the transformer is achieved by providing the lead avoiding notch on a part of the magnetic core to allow the lead to be drawn from the inside of the magnetic core.

In the invention, increase in loss or increase in temperature rise of the transformer can be prevented by providing the lead avoiding step at a part of the magnetic core and drawing the coil-drawn-lead from the gap, and hence a compact and high-efficiency transformer can be realized.

INDUSTRIAL APPLICABILITY

According to the transformer in the invention, since insertion and lamination of coils in the bobbin can be performed easily in a short time, the number of processes of operation can be significantly reduced in the case of the transformer in which a number of coils are laminated, and a product which is low in price can be provided. According to the transformer in the invention, increase in loss or increase in temperature rise can be prevented, and hence a compact and high-efficiency transformer can be realized.

The invention claimed is:

1. A transformer comprising:

a coil part having a first bobbin to which a coil is mounted, a second bobbin to be fitted to the first bobbin combined to each other, the coil part being sandwiched between magnetic cores from above below; and a plurality of drawn lead introduction walls on the bobbin, wherein the first bobbin includes at least one lead drawing through holes on a periphery on the inner peripheral side of a coil mounting surface, and at least one of coil-drawn-leads of the coil is drawn through the lead drawing through hole, the drawn lead introduction walls are positioned adjacent the at least one lead drawing through holes so as to extend substantially perpendicular with respect to the coil mounting surface, and the drawn lead introduction walls are different in height from each other.

2. The transformer of claim 1, wherein the shape of the lead drawing through hole is oval.

3. The transformer of claim 1, wherein at least one of the magnetic cores comprises a lead avoiding notch for avoiding the coil-drawn-lead.

4. The transformer of claim 1, wherein at least one of the magnetic cores comprises a lead avoiding step for avoiding the coil-drawn-lead.

* * * * *

UNITED STATES PATENT AND TRADEMARK OFFICE

CERTIFICATE OF CORRECTION

PATENT NO. : 7,714,687 B2
APPLICATION NO. : 10/592170
DATED : May 11, 2010
INVENTOR(S) : Marui et al.

It is certified that error appears in the above-identified patent and that said Letters Patent is hereby corrected as shown below:

In column 8, line 39 of the Letters Patent, in claim 1 "from above below; and" should read --from above and below; and--.

Signed and Sealed this

Twelfth Day of October, 2010

David J. Kappos

David J. Kappos
*Director of the United States Patent and Trademark Office*